US005881395A

United States Patent [19]

Donzis

[11] Patent Number: 5,881,395

[45] Date of Patent: Mar. 16, 1999

[54] IMPACT ABSORBING PAD

[76] Inventor: Byron A Donzis, 3008 Rodgerdale, Houston, Tex. 77042

[21] Appl. No.: 353,967

[22] Filed: Dec. 9, 1994

Related U.S. Application Data

[63] Continuation of Ser. No. 58,531, Jul. 8, 1993, abandoned.

[51] Int. Cl.[6] ..... A41D 13/00

[52] U.S. Cl. ..... 2/455; 2/459; 2/463; 2/464; 2/465; 2/24; 2/267

[58] Field of Search ..... 2/2, 267, 268, 2/24, 455, 459, 461, 462, 463, 464, 465; 428/71, 78, 304.4, 316.6, 230, 246; 5/420, 450

[56] References Cited

U.S. PATENT DOCUMENTS

| | | | |
|---|---|---|---|
| Re. 31,898 | 5/1985 | Suter . | |
| 1,602,454 | 10/1926 | Riddell . | |
| 2,635,240 | 4/1953 | Tausch . | |
| 3,044,075 | 7/1962 | Rawlings . | |
| 3,058,124 | 10/1962 | Sturtevant | 5/450 X |
| 3,123,403 | 3/1964 | Hood . | |
| 3,248,738 | 5/1966 | Morgan . | |
| 3,254,883 | 6/1966 | Morgan . | |
| 3,465,364 | 9/1969 | Edelson . | |
| 3,500,472 | 3/1970 | Castellani . | |
| 3,585,639 | 6/1971 | Enicks . | |
| 3,609,764 | 10/1971 | Morgan . | |
| 3,675,377 | 7/1972 | Suter . | |
| 3,849,801 | 11/1974 | Holt et al. . | |
| 3,866,241 | 2/1975 | Grant . | |
| 3,872,511 | 3/1975 | Nichols . | |
| 3,882,547 | 5/1975 | Morgan . | |
| 3,921,222 | 11/1975 | Hollman . | |
| 3,995,320 | 12/1976 | Zafuto . | |
| 3,999,220 | 12/1976 | Keltner . | |
| 4,195,362 | 4/1980 | Rolando . | |
| 4,272,847 | 6/1981 | Buhler . | |
| 4,461,800 | 7/1984 | Tanaka | 428/230 X |
| 4,486,901 | 12/1984 | Donzis . | |
| 4,507,801 | 4/1985 | Kavanaugh et al. | 2/2 |
| 5,168,576 | 12/1992 | Krent et al. | 2/2 |
| 5,271,101 | 12/1993 | Speth et al. | 2/276 X |

FOREIGN PATENT DOCUMENTS

| | | | |
|---|---|---|---|
| 8505549 | 12/1985 | European Pat. Off. | 5/450 |
| 24020 | 10/1907 | United Kingdom . | |
| 861983 | 3/1961 | United Kingdom . | |
| 984604 | 2/1965 | United Kingdom | 5/450 |

*Primary Examiner*—Diana L. Biefeld
*Attorney, Agent, or Firm*—Butler & Binion,L.L.P.; Sue Z. Shaper

[57] ABSTRACT

An improved impact absorbing pad comprising a foam core attached to and enclosed within a generally air impermeable covering, having at least one selected air permeable region, and wherein at least a portion of the covering enclosing one side of the core is comprised of stretch fabric.

14 Claims, 6 Drawing Sheets

FIG. 5a
(PRIOR ART)
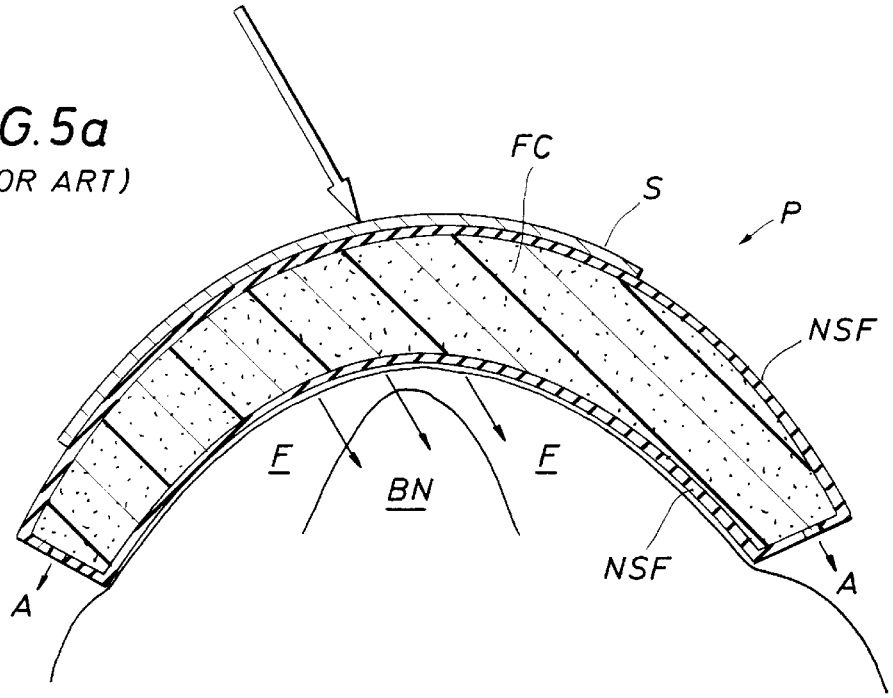
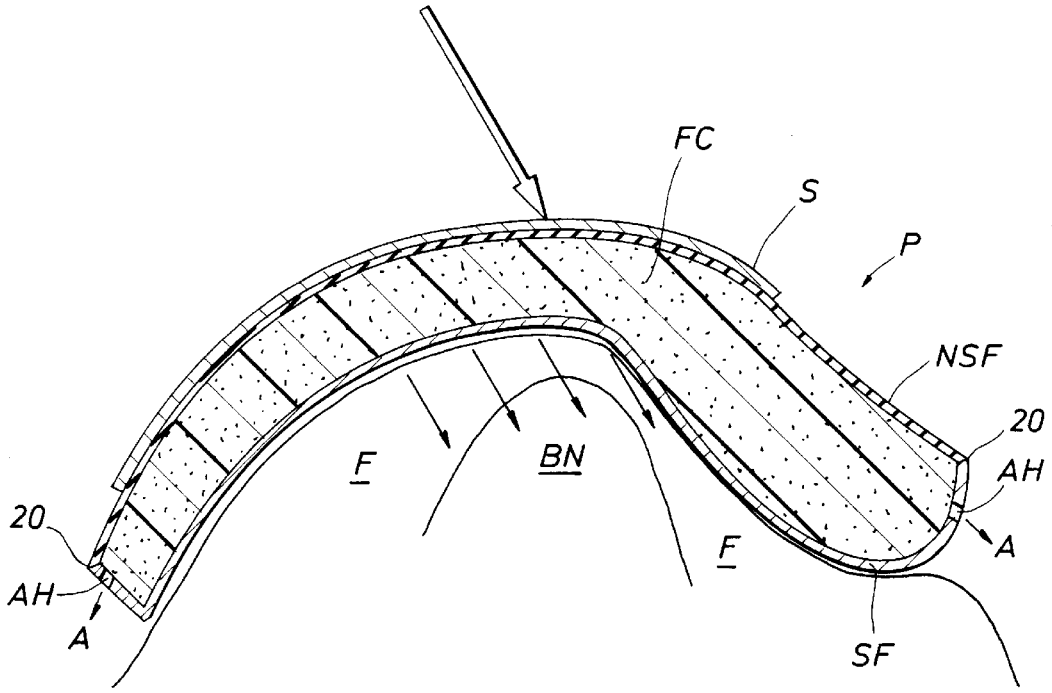
FIG. 5b

IMPACT ABSORBING PAD

This application is a continuation application of Ser. No. 08/058,531, filed Jul. 8, 1993, now abandoned.

SPECIFICATION

FIELD OF THE INVENTION

This invention relates to the field of impact absorbing pads for the protection of humans and animals from the forces occasioned by the absorption of blows, and more particularly, to improved pads of the air management type.

BACKGROUND OF THE INVENTION

Impact absorbing protective pads, used to protect humans and animals from absorbing forces, are generally known. Such pads may include cotton padding, foam padding, air bladders, composite foam cores and pads incorporating air management systems. In particular, the present inventor's own U.S. Pat. Nos. 4,486,901 and 4,513,449 and the references cited therein disclose a variety of types and styles of protective pads.

A key function of human or animal impact absorbing pads, as taught in the art, is to absorb and disperse the force of individual impacts. Absorbing and dispersing the forces minimizes the amount of force to be absorbed by the underlying body and extends the area of the body over which the force may be absorbed.

Notwithstanding the acknowledged improvements taught and disclosed in the above references, including in particular air management systems, statistics are now showing that athletes in contact sports are subject to above their normal or expected level of arthritic complaints. Complaints from these athletes appear to occur at earlier ages than in the general population and, significantly, apparently relate to areas of the body that have repeatedly absorbed impact. These areas of the body may never have absorbed any single injury-causing blow.

The present invention is directed toward ameliorating at least in part, the above situation. One intent of the invention is to further reduce and disperse the amount of forces that might be repeatedly absorbed by prominent bones under pads.

The invention has further advantages. It provides a better fitting, and more comfortable body pad, capable of conforming more exactly to the desired contours of the body. It provides a pad covering that enhances the structural integrity of the foam core. It exhibits what is referred to as "good hand" in the trade.

SUMMARY OF THE INVENTION

The present invention relates to an improved impact absorbing pad comprised of a foam core attached to and enclosed within a generally air impermeable covering that has selected air permeable regions. In the pad of the present invention at least a portion of the covering enclosing the core is comprised of stretch fabric. LYCRA and Spandex have been found to be particularly appropriate stretch fabrics.

One preferred embodiment teaches a covering comprised of a traditional nylon and novel LYCRA stretch fabric combination. The stretch fabric is utilized as the inside, body contact side, covering for the core.

The foam may be attached to the fabric covering by heat sealing a urethane coating between the fabric and the foam, as is known. A urethane coating renders fabrics generally air impermeable. Air holes may then be strategically added to the covering, usually on the rim sides of the pad, to provide selected air permeable regions for air management. A flexible solid shield structure may be attached to the outside facing surface of the pad.

It is possible that the stretch fabric may form the complete covering for the core. The stretch fabric may also be bonded to a composite of foam sandwiched within the core.

The foam core may comprise a single foam or a composite of foams, as is known in the art. If the core comprises a composite of foams, the composite is preferably structured into layers. Alternately, the foam core might be injection molded within a covering.

BRIEF DESCRIPTION OF THE DRAWINGS

A better understanding of the present invention can be obtained when the following detailed description of the preferred embodiment is considered in conjunction with the following drawings, in which:

FIGS. 5*a* through 5*e* compare the action of protective pads of the prior art with protective pads of the present invention.

DETAILED DESCRIPTION OF THE PREFERRED EMBODIMENT

Figure 2:
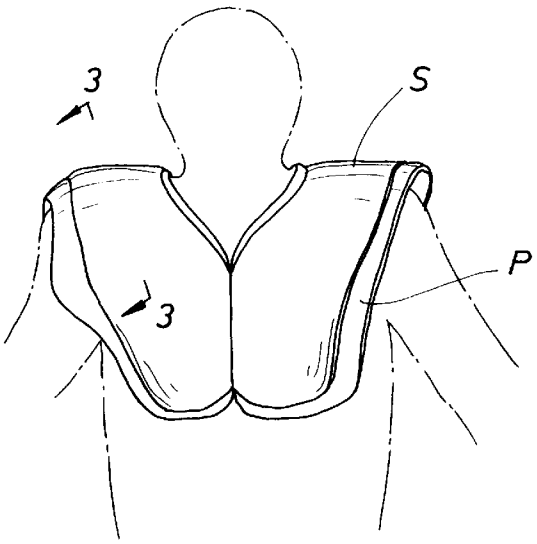
FIGS. 1 and 2 generally illustrate impact absorbing protective body pads.

Traditionally, protective pads for athletic equipment include a relatively hard outer shell and an inner layer of soft padding. As so constructed, the outer layer receives the blow and spreads the forces to be absorbed over a large area. The forces to be absorbed are cushioned by the soft padding. As is taught in U.S. Pat. No. 4,486,901, it is known to construct shock absorbing equipment utilizing foam cores for padding.

The art of protective pads further teaches air impermeable or generally air impermeable enclosures or bladders. Generally air impermeable enclosures are taught to contain certain specified air channels to enable a controlled transfer of air out of and into the interior of the pad. This controlled management of air has been shown to provide further effective means for diffusing the forces of impact and for absorbing impact energy.

U.S. Pat. No. 4,486,901 discloses such an air management system, teaching a foam core covered with a non-stretch fabric. The import of the U.S. Pat. No. 4,486,901 invention was to diffuse the energy of single blows using air management. Reducing cumulative effects on from repetitiously absorbing low level forces was not taught in the '901.

Specifically disclosed in the '901 was a preferably nylon fabric covering, coated with urethane. FIGS. 6*a* through 6*h* illustrate how the fabric of the '901 was disclosed and taught. Review of FIGS. 6*a* through 6*h* and the text related thereto illustrates no stretching of any portion of the enclosure and discusses no effects, benefits and/or problems associated with such stretching. Clearly, the stretching would have complicated and partially canceled the intended effect of a pure air management system in diffusing the energy of a blow. The industry, following the disclosure of the '901, teaches the construction of impact absorbing pads using nylon or similar types of non-stretch fabric if and when fabric is utilized in the covering for the core of pads.

To the contrary of the teachings of the industry and the '901, the present invention discloses a hithertofore unappreciated advantage from using a "stretch" fabric bonded to the surface of at least a portion of a foam core in an impact absorbing pad. Using stretch fabric to form part of the generally air impermeable covering of a foam core exhibits certain novel and now believed advantageous shock dispersing and absorbing properties, in particular from a long term perspective. One particular property is the ability to disperse even further forces otherwise absorbed by prominent underlying bones. This appears advantageous, even when the forces individually are already of a lower level, because of the possible deleterious cumulative effect from the continuous absorption of such forces.

The use of a stretch fabric, such as a LYCRA or a Spandex, for a portion of the cover of the core, the fabric being rendered generally air impermeable by a polyurethane coating as is taught in an air management system, appears to offer an advantageous trade off between gains and losses of diffusion and absorption characteristics within an air management system. First, the stretch fabric performs an analogous function to the air. That is, a portion of the energy from the impacting force is expended in stretching the fabric and the foam attached to the fabric as well as in expelling air from the core. A similar absorption of force by the covering and core is not possible with pads having a non-stretch fabric enclosure. Indeed, sharp forces have been discovered to shatter or split foam cores enclosed within nonstretch fabric coverings. Although the core inherently could expand to absorb the force without splitting, attachment to a nonstretch covering does not permit this natural expansion. Impact absorbing gain from the absorption of energy to stretch the covering and the foam more than offsets impact absorbing losses due to reduction in the forces working to expell the air.

Secondly, and in particular, when the pad overlies malleable soft flesh as well as bone, it has been found that the stretch fabric attached to the foam tends to mirror the behavior of skin and flesh. By stretching and compressing against a greater body surface area, and wherein the additional area comprising largely area of soft flesh rather than bone, the pad diffuses the forces of impact away from prominent underlying points of bone over which the pad is situated, thus diminishing the likelihood of suffering from repeated long term force absorption.

Figure 1:
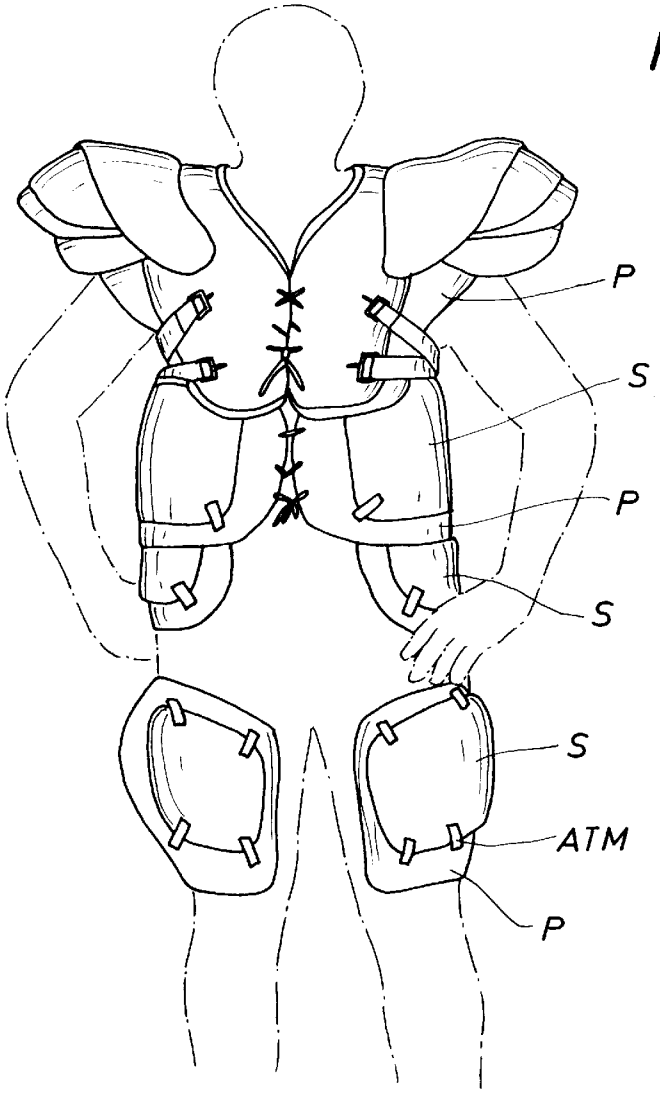

FIGS. 1 and 2 illustrate typical impact absorbing pads as worn on a human body. These pads illustrate flexible solid shield structures attached by suitable attaching mechanisms ATM to underlying pad portions P.

Figure 3:
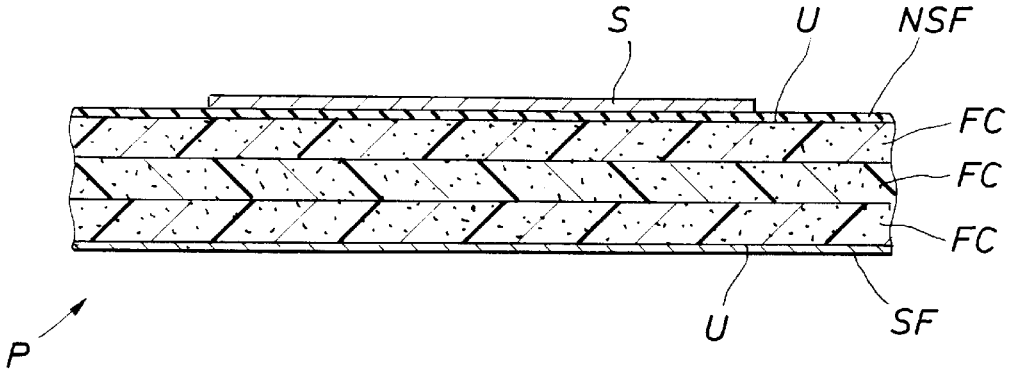
FIGS. 3, 3*a* and 4 illustrate in cross-section impact absorbing pads with the improvement of the present invention.
Figure 3A:
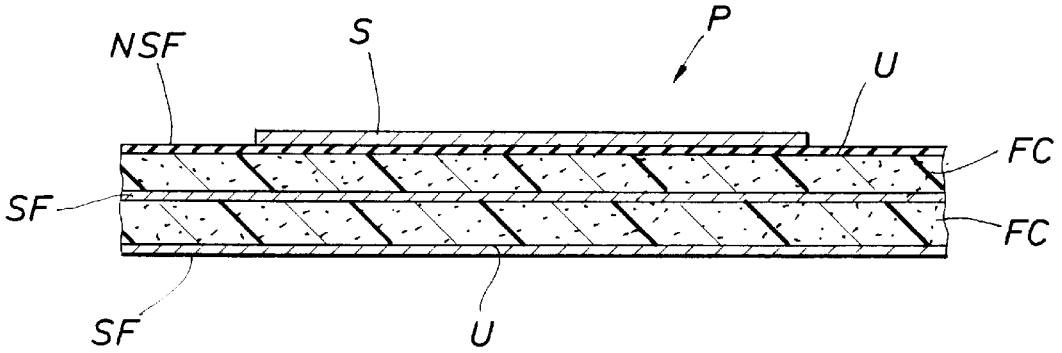
Figure 4:
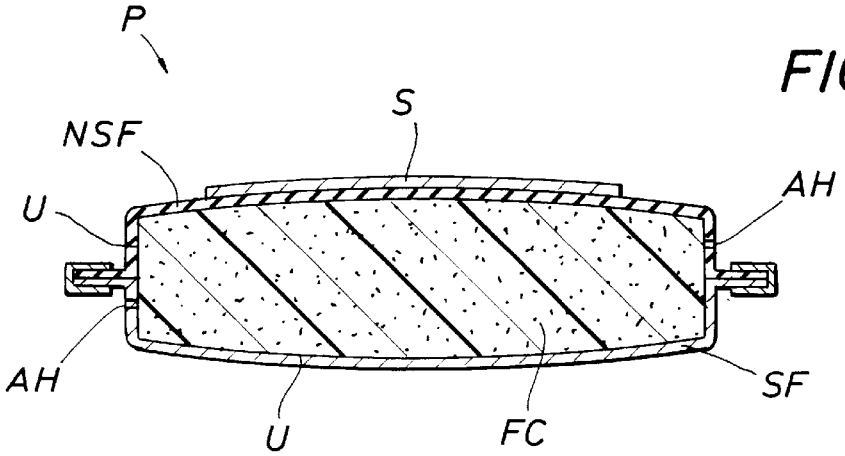

FIGS. 3, 3*a* and 4 illustrate by cross-section the composition of an impact absorbing pad in accordance with the present invention. FIG. 3 illustrates pad P with a foam core FC comprised of a three-ply composition. FIG. 3 also illustrates the solid flexible structural shield S attached to nonstretch fabric covering NSF that is in turn attached to one of the foam core plys FC. A urethane coating U lies on the underside of nonstretch fabric NSF. Coating U, in fact, may be heat sealed to bond nonstretch fabric NSF to foam core ply FC. In accordance with the teachings of the present invention, a stretch fabric SF, also having a urethane coating U on its inside, is shown covering the bottom ply of the three-ply foam core FC.

FIG. 3*a* illustrates a similar arrangement to the embodiment of FIG. 3. However, in FIG. 3*a* an interior layer of stretch fabric SF is also shown bonded between two plys of foam core FC.

The embodiment of FIG. 4 illustrates an impact absorbing pad containing a single ply of foam core FC in the interior. FIG. 4, in accordance with the teachings of air management impact absorbing pads, illustrates air holes AH which permit air to exit and enter the interior of the pad according to structural design, the covering for the pad being generally air impermeable. Stretch fabric SF and nonstretch fabric NSF cover foam core FC. Each fabric is shown coated with a urethane coating U upon its interior surface. FIG. 4 further illustrates one manner in which stretch fabric SF and nonstretch fabric NSF may be bound together at the sides of the pad. Again, urethane coating U may be heat sealed between the outside of foam core FC and the inside of covering SF and NSF. The heat seal serves to attach the covering to the core. Adhesive could also be used to attach the covering to the core.

Figure 5C:
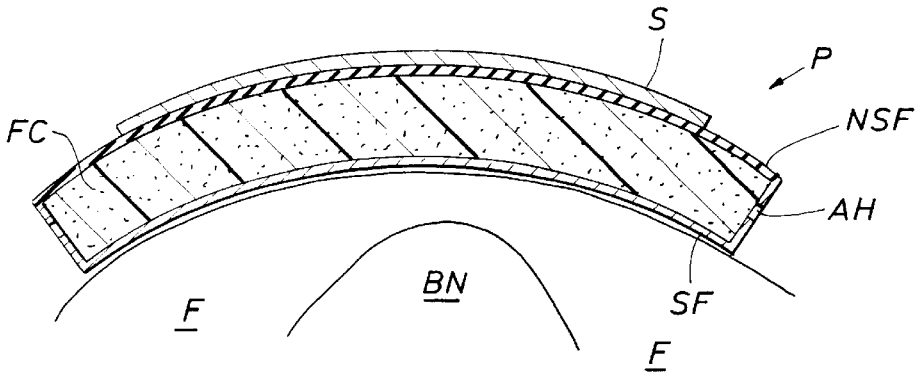
Figure 5D:
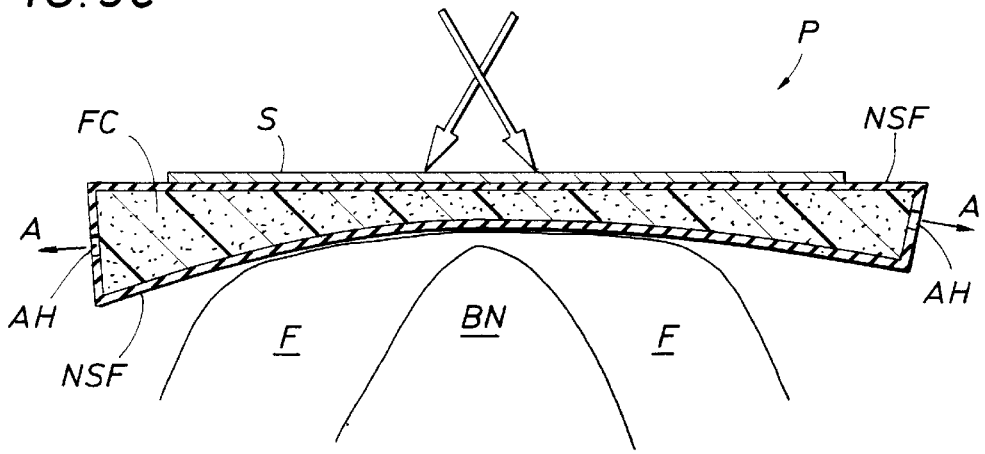
FIG. 5d (PRIOR ART)
Figure 5E:
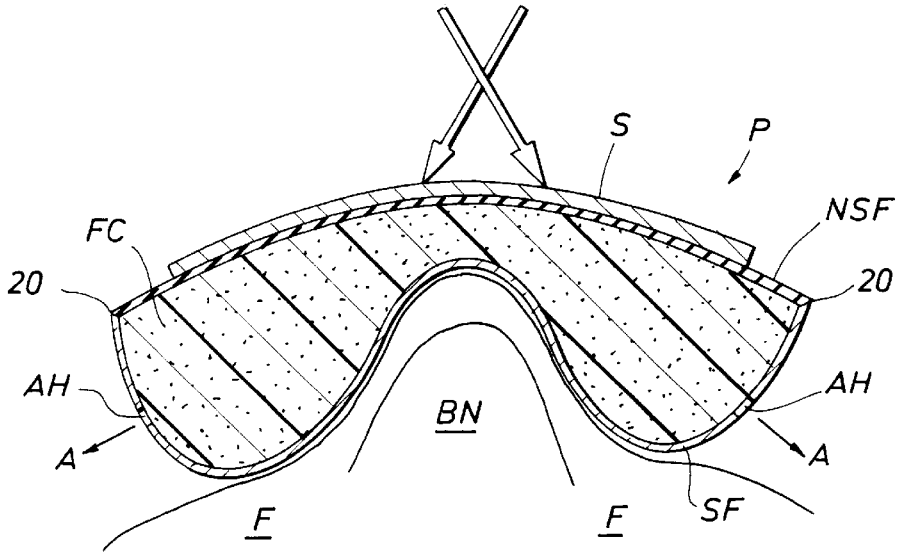
Figure 6A:
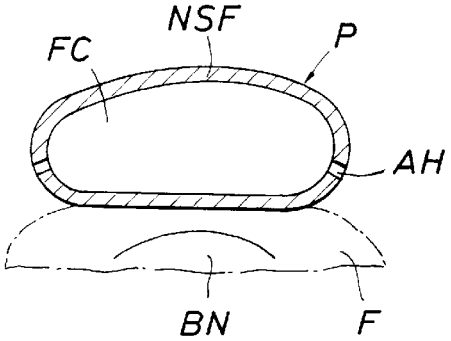
FIG. 6a (PRIOR ART)
FIGS. 6*a*–6*h* and FIGS. 7*a*–7*d* compare the performance of pads of the prior art (FIGS. 6) with pads of the present invention (FIGS. 7).
Figure 6B:
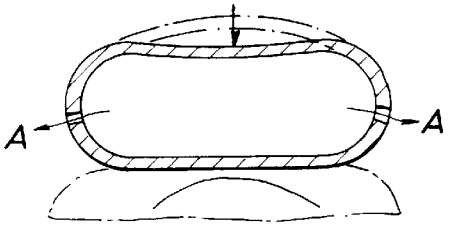
FIG. 6b (PRIOR ART)
Figure 6C:
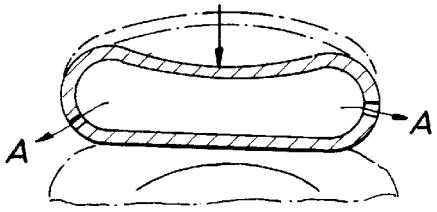
FIG. 6c (PRIOR ART)
Figure 6D:
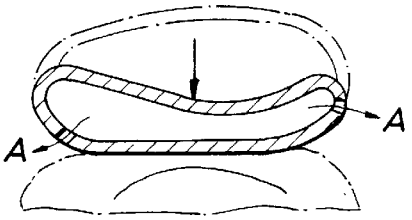
FIG. 6d (PRIOR ART)
Figure 6E:
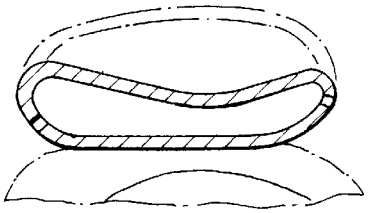
FIG. 6e (PRIOR ART)
Figure 6F:
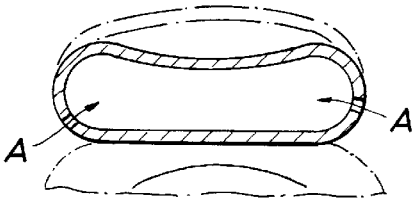
FIG. 6f (PRIOR ART)
Figure 6G:
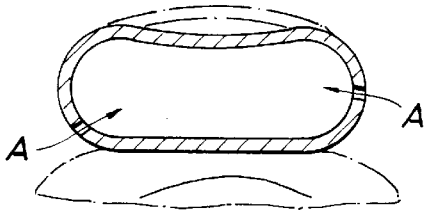
FIG. 6g (PRIOR ART)
Figure 6H:
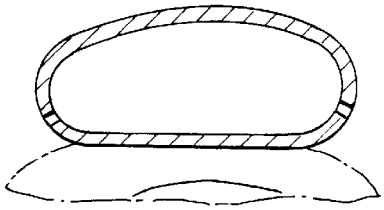
FIG. 6h (PRIOR ART)
Figure 7A:
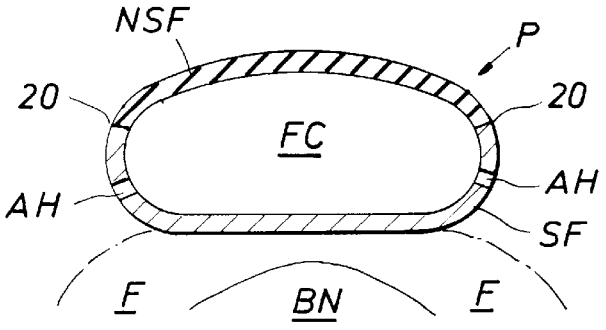
Figure 7B:
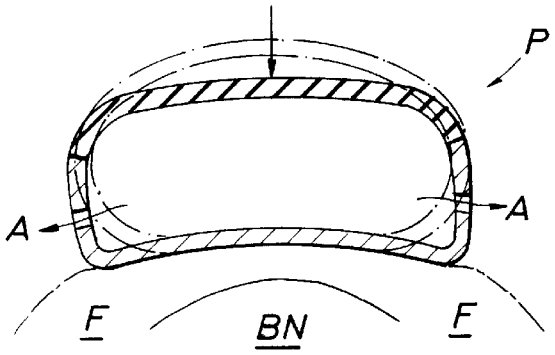
Figure 7C:
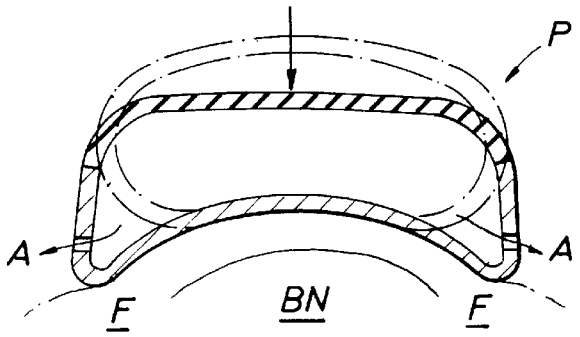
Figure 7D:
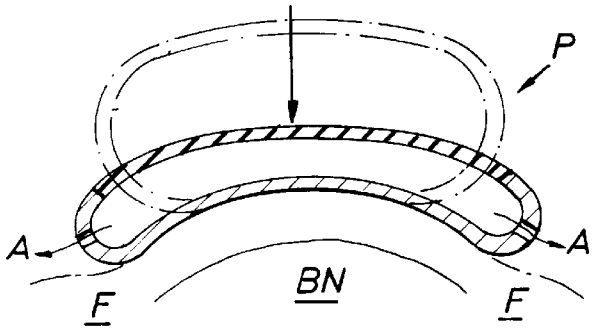

FIGS. 5*a* and 5*b* illustrate the difference between pads of the prior art and the pad of the instant invention. FIGS. 5*a* and 5*b* both show a pad fitting over a portion of a body comprised of flesh F and bone BN. As a force impinges upon shield S of the prior art pad P of FIG. 5*a*, covered with all nonstretch fabric NSF, the pad compresses and tends to move uniformly against the body, thereby imparting significant forces to a prominent point of bone BN. As the same force impinges upon the pad of FIG. 5*b*, the drawing illustrates an advantage of the present invention. As can be seen by comparison of FIG. 5*b* and 5*a*, stretch fabric SF covering the inside of foam core FC of the pad of FIG. 5*b* tends to stretch and press in against the soft flesh of the body in the direction of the impinging force. Air A is shown exiting air hole AH, as is usual. A further effect of the air generally entrapped within the foam core of the pad of FIG. 5*b*, however, is to force the stretch fabric SF and cells of foam core FC to stretch in the direction of the blow. Thus, FIG. 5*b* illustrates how more of the elastic properties of the pad, as well as more of the soft flesh F of the body, are used to absorb the force of the blow. This reduces the force that must be absorbed by the prominent points of underlying bone BN. In the embodiment of FIG. 5*b*, stretch fabric SF is shown generally attached to nonstretch fabric NSF at points 20. The manner and placement of the means for attachment is largely a matter of design choice. FIG. 5*c* again shows a pad P resting on a body comprised of flesh F and bone BN. FIGS. 5*d* and 5*e* show forces impinging upon the top of pad P. The prior art pad P of FIG. 5*d* contains nonstretch fabric covering NSF. Pad P of FIG. 5*e* contains stretch fabric covering at least on the inside of the pad. FIGS. 5*d* and 5*e* both show air exiting the pad through air holes AH in the sides of pad P upon the receipt of a blow to shield S. Generally, the effect of forces upon the all nonstretch fabric covered pad of FIG. 5*d* shows how the prior art pad tends to press against the prominent point of bone BN. In contrast, the FIG. 5*e* shows that upon the impingement of force on improved pad P, air A within foam core FC not only exits air holes AH but also stretches stretch fabric SF and the cells of foam core FC down against the softer flesh F of the body of the wearer. Thus, less force is absorbed by the prominent points of bone BN of the body underlying the improved pad of FIG. 5*e*.

The pad P of FIGS. 6*a* through 6*h* is covered with nonstretch fabric, as taught in the prior art. As a force impinges upon the top of pad P the progression of Figures from 6*b* through 6*h* shows how the pad tends to compress against the underlying flesh F and bone BN of the body. Air H exits air holes AH and pad P compresses. When the force is let up, as shown in FIGS. 6*e* through 6*h*, air rushes back in through air holes AH and the prior art pad returns to its former shape by virtue of the extension of foam core FC to its original shape.

FIGS. 7*a* through 7*d* illustrate, in contrast, a pad of the present invention that is covered, at least in part, with a stretch fabric SF. In particular stretch fabric SF is found on the pad's inside surface and a nonstretch fabric NSF on its outside. As a force impinges upon the top of the improved pad, the lower surfaces of the pad tend to stretch outward and press against further areas of soft flesh F of the body. Pad P not only compresses but stretches laterally in directions that least resist movement, which will be areas of soft flesh as opposed to areas of underlying bone BN. Upon release of the force impinging from the top, pad P of FIGS. 7*a* through 7*d* will recover its original shape, much the same as the pad of FIG. 6.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

What is claimed is:

1. An improved air management impact absorbing pad comprising:

a foam core attached to and enclosed within a generally air-impermeable covering defining a pad having a top side and a bottom side and air management holes in said covering structured and sized in relation to said core for providing controlled transfer of air into and from said pad such that the holes perform a significant impact absorbing function; and wherein the foam of the core is comprised of two or more foam layers with a stretch fabric bonded between the foam layers.

2. The improved impact absorbing pad if claim 1 wherein said air management holes are located on rim sides of said pad.

3. An improved air management impact absorbing pad, comprising:

a foam core attached to and enclosed within a generally air impermeable covering defining a pad having a top side and a bottom side and having air management holes in said covering structured and sized in relation to said core to provide controlled transfer of air into and from said pad such that the holes perform a significant impact absorbing function; and wherein the improvement comprises at least a portion of said covering defining said bottom side being of stretch fabric while said covering substantially defining said top side is of non-stretch fabric.

4. The improved impact absorbing pad of claim 3 wherein said air management holes are located on rim sides of said pad.

5. The pad of claim 3 wherein a flexible solid shield structure is attached to one side of the pad.

6. The pad of claim 3 wherein a side of the foam core enclosed by stretch fabric is contoured to fit against a portion of a body.

7. The pad of claim 3 wherein the generally air impermeable covering is comprised of a fabric having a urethane coating.

8. The pad of claim 3 wherein the foam is bonded on substantially all sides to the covering.

9. The pad of claim 8 wherein the bond is comprised of a heat seal of a urethane coating between the covering and the foam.

10. The pad of claim 3 wherein a portion of the covering comprises non-stretch fabric.

11. The pad of claim 10 wherein the non-stretch fabric comprises nylon.

12. The pad of claim 3 wherein the foam of the core is comprised of a composite of foams.

13. The pad of claim 12 wherein the composite comprises two or more foam layers bonded together.

14. The pad of claim 3 wherein the foam of the core comprises an injection molded foam core within the covering.

* * * * *